US011012774B2

(12) United States Patent
Sheaffer et al.

(10) Patent No.: US 11,012,774 B2
(45) Date of Patent: May 18, 2021

(54) SPATIALLY BIASED SOUND PICKUP FOR BINAURAL VIDEO RECORDING

(71) Applicant: Apple Inc., Cupertino, CA (US)

(72) Inventors: Jonathan D. Sheaffer, San Jose, CA (US); Joshua D. Atkins, Los Angeles, CA (US); Peter A. Raffensperger, Cupertino, CA (US); Symeon Delikaris Manias, Los Angeles, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 16/575,178

(22) Filed: Sep. 18, 2019

(65) Prior Publication Data

US 2020/0137489 A1 Apr. 30, 2020

Related U.S. Application Data

(60) Provisional application No. 62/752,292, filed on Oct. 29, 2018.

(51) Int. Cl.

| | |
|---|---|
| ***H04R 3/00*** | (2006.01) |
| ***G10L 19/08*** | (2013.01) |
| ***H04R 5/04*** | (2006.01) |
| ***H04S 7/00*** | (2006.01) |
| *H04R 1/02* | (2006.01) |
| *G10L 21/0216* | (2013.01) |

(52) U.S. Cl.

CPC ..... *H04R 3/005* (2013.01); *G10L 19/08* (2013.01); *H04R 5/04* (2013.01); *H04S 7/302* (2013.01); *G10L 2021/02166* (2013.01); *H04S 2400/11* (2013.01)

(58) Field of Classification Search

CPC ..... H04R 3/005; H04R 5/04; G10L 19/08; G10L 2021/02166; H04S 7/302; H04S 2400/11

USPC ..... 381/92, 91

See application file for complete search history.

(56) References Cited

U.S. PATENT DOCUMENTS

| | | | | |
|---|---|---|---|---|
| 9,338,420 | B2 | 5/2016 | Xiang | |
| 10,178,490 | B1 | 1/2019 | Sheaffer et al. | |
| 2010/0123785 | A1 | 5/2010 | Chen et al. | |
| 2013/0177923 | A1* | 7/2013 | Uttenthal | G01N 33/6893 435/7.4 |

(Continued)

OTHER PUBLICATIONS

Heller, Aaron J., et al., "A Toolkit for the Design of Ambisonic Decoders," Presented at the Linux Audio Conference 2012, Apr. 12, 2012, 12 pages.

(Continued)

*Primary Examiner* — Ammar T Hamid

(74) *Attorney, Agent, or Firm* — Womble Bond Dickinson (US) LLP

(57) ABSTRACT

A method for producing a target directivity function that includes a set of spatially biased HRTFs. A set of left ear and right ear head related transfer functions (HRTFs) are selected. The left ear and right ear head HRTFs are multiplied with an on-camera emphasis function (OCE), to produce the spatially biased HRTFs. The OCE may be designed to shape the sound profile of the HRTFs to provide emphasis in a desired location or direction that is a function of the specific orientation of the device as it is being used to make a video recording. Other aspects are also described and claimed.

20 Claims, 5 Drawing Sheets

(56) References Cited

U.S. PATENT DOCUMENTS

| | | | | |
|---|---|---|---|---|
| 2013/0272539 | A1* | 10/2013 | Kim | H04S 7/40 381/92 |
| 2013/0342731 | A1* | 12/2013 | Lee | H04N 9/8211 348/231.4 |
| 2015/0230026 | A1* | 8/2015 | Eichfeld | H04R 5/027 381/26 |
| 2016/0165339 | A1* | 6/2016 | Benattar | H04R 1/406 381/92 |
| 2016/0330560 | A1* | 11/2016 | Chon | G10L 19/20 |
| 2018/0046431 | A1* | 2/2018 | Thagadur Shivappa | G06F 3/011 |
| 2019/0246218 | A1* | 8/2019 | Hertzberg | G06F 3/012 |

OTHER PUBLICATIONS

Madmoni, Lior, et al., "Beamforming-based Binaural Reproduction by Matching of Binaural Signals," AES 2020 Conference on Audio for Virtual and Augmented Reality, Aug. 17, 2020, 8 pages.

* cited by examiner

SPATIALLY BIASED SOUND PICKUP FOR BINAURAL VIDEO RECORDING

This non-provisional patent application claims the benefit of the earlier filing date of U.S. provisional patent application No. 62/752,292 filed Oct. 29, 2018.

FIELD

An aspect of the disclosure here relates to spatially biased binaural audio for video recording. Other aspects are also described.

BACKGROUND

Binaural recording of audio facilitates a means for full 3D sound capture—in other words, being able to reproduce the exact sound scene and giving the user a sensation of 'being there.' This can be accomplished through spatial rendering of audio inputs using head related transfer functions (HRTF), which modifies a sound signal in order to induce the perception in a listener that the sound signal is originating from any point in space. While this approach is compelling for, for example, full virtual reality applications, in which a user can interact both visually and audibly in a virtual environment, in traditional video capture applications three dimensional sounds can distract the viewer from the screen. In contrast, monophonic or traditional stereophonic recordings may not provide a sufficient sense of immersion.

SUMMARY

An aspect of the disclosure is directed to a method for producing a spatially biased sound pickup beamforming function, to be applied to a multi-channel audio recording of a video recording. The method includes generating a target directivity function. The target directivity function includes a set of spatially biased head related transfer functions. A left ear set of beamforming coefficients and a right ear set of beamforming coefficients may be generated by determining a best fit for the target directivity function based on a device steering matrix. The left ear set of beamforming coefficients and the right ear set of beamforming coefficients may then be output and applied to the multichannel audio recording to produce more immersive sounding, spatially biased audio for the video recording.

Another aspect is directed towards a method for producing the target directivity function, which includes a set of spatially biased HRTFs. The method includes selecting a set of left ear and right ear head related transfer functions (HRTFs). The left ear and right ear head HRTFs are multiplied with an on-camera emphasis function (OCE), to produce the spatially biased HRTFs. The OCE may be designed to modify the sound profile of the HRTFs to provide emphasis in one or more desired directions, e.g., directly ahead where the camera is being aimed, as a function of the orientation of the recording device when the device is recording video in a specific orientation.

An aspect is directed towards a system for producing a sound pickup beamforming function to be applied to a multi-channel audio recording of a recorded video, during playback of the recorded video. The system includes a processor that receives a device steering matrix and a target directivity function. The processor then generates the beamforming coefficients by employing numerical optimization techniques, such as the least squares method, to find the regularized best fit of the inputted device steering matrix to the target directivity function Another aspect is a method for asymmetric equalization. Asymmetric equalization involves receiving a plurality of beamforming coefficients for a first ear and then calculating a diffuse field power average across a plurality of beamforming coefficients. A correction filter is applied to the beamforming coefficients such that the diffuse field power average of the plurality of beamforming coefficients equals the diffuse field power average of a single microphone, and then a first ear beamforming coefficient is output. The asymmetric equalization method reduces errors in the resulting inter-aural level differences that arise due to an asymmetric microphone arrangement on the device.)

The above summary does not include an exhaustive list of all aspects of the present disclosure. It is contemplated that the disclosure includes all systems and methods that can be practiced from all suitable combinations of the various aspects summarized above, as well as those disclosed in the Detailed Description below and particularly pointed out in the Claims section. Such combinations may have particular advantages not specifically recited in the above summary.

BRIEF DESCRIPTION OF THE DRAWINGS

Several aspects of the disclosure here are illustrated by way of example and not by way of limitation in the figures of the accompanying drawings in which like references indicate similar elements. It should be noted that references to "an" or "one" aspect in this disclosure are not necessarily to the same aspect, and they mean at least one. Also, in the interest of conciseness and reducing the total number of figures, a given figure may be used to illustrate the features of more than one aspect of the disclosure, and not all elements in the figure may be required for a given aspect.

DETAILED DESCRIPTION

Several aspects of the disclosure with reference to the appended drawings are now explained. Whenever the shapes, relative positions and other aspects of the parts described are not explicitly defined, the scope of the invention is not limited only to the parts shown, which are meant merely for the purpose of illustration. Also, while numerous details are set forth, it is understood that some aspects of the disclosure may be practiced without these details. In other instances, well-known circuits, structures, and techniques have not been shown in detail so as not to obscure the understanding of this description.

In the description, certain terminology is used to describe the various aspects of the disclosure here. For example, in certain situations, the terms "component," "unit," "module,"

and "logic" are representative of hardware and/or software configured to perform one or more functions. For instance, examples of "hardware" include, but are not limited or restricted to an integrated circuit such as a processor (e.g., a digital signal processor, microprocessor, application specific integrated circuit, a micro-controller, etc.). Further, "a processor" may encompass one or more processors, such as a processor in a remote server working with a processor on a local client machine. Similarly, aspects of the disclosure that appear to be conducted by multiple processors could be accomplished by a single processor. Of course, the hardware may be alternatively implemented as a finite state machine or even combinatorial logic. An example of "software" includes executable code in the form of an application, an applet, a routine or even a series of instructions that may be part of an operating system. The software may be stored in any type of machine-readable medium.

Figure 1:
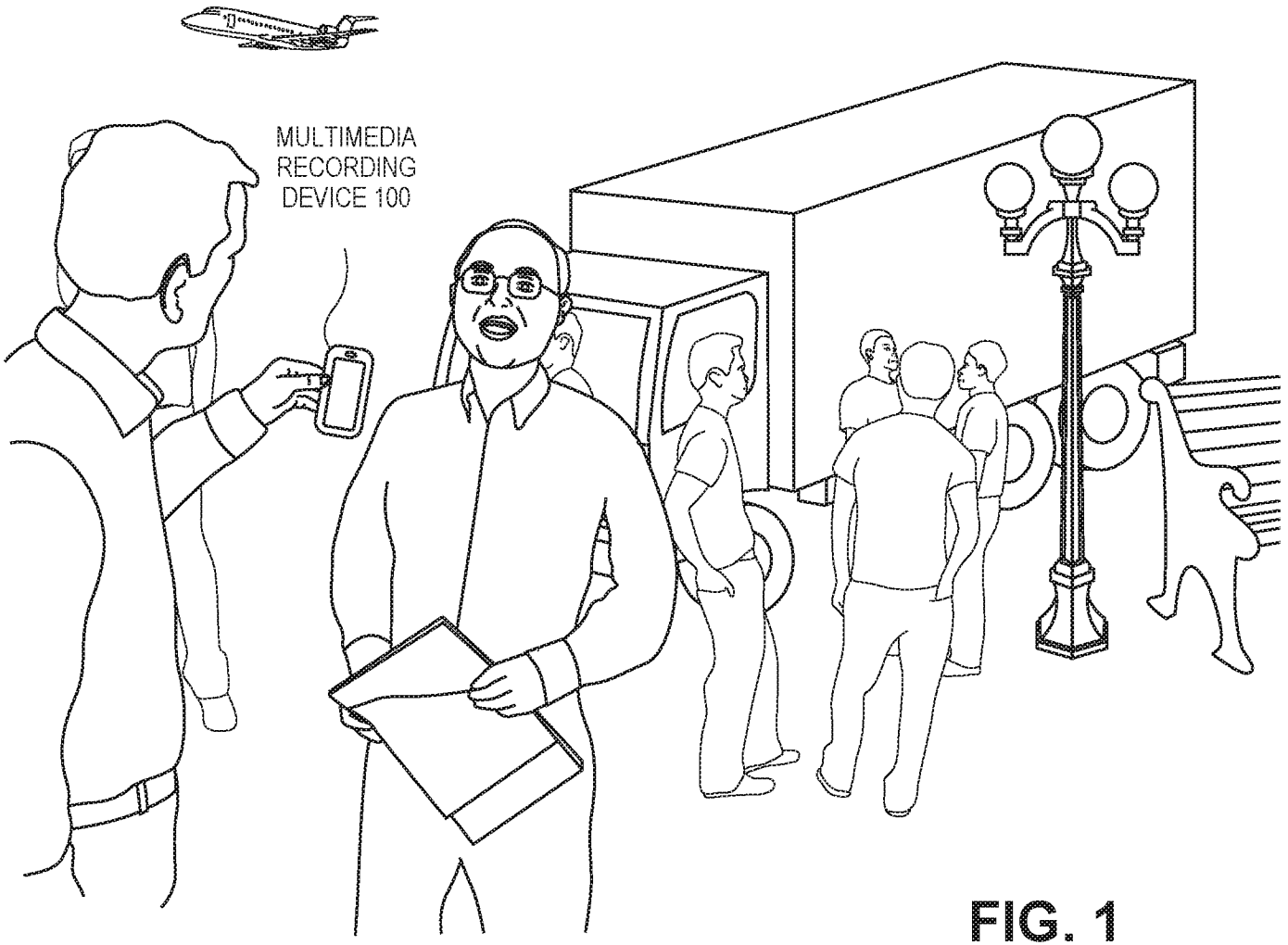
FIG. 1 depicts a multimedia recording device during use.

Referring to FIG. 1, a multimedia recording device 100 (also referred to here as a video recording device which is capable of simultaneously recording audio) is shown, in this example as a smartphone that is recording a sound environment and capturing video. It does so by simultaneously recording from a built-in free-field microphone array 133 (composed of several individual microphones 107), and from one of its two built-in cameras, first camera 103 or second camera 106. The array 133 and the cameras have been strategically placed on the housing of the device 100. The multimedia recording device 100 could be a smartphone, a camcorder, or other similar devices. Thereafter, when performing a playback of the recorded audio-video with spatial sound rendering of the multichannel audio, the listener is able to (using perceived, small differences in timing and sound level introduced by the spatial sound rendering process) derive roughly the positions of the sound sources, thereby enjoying a sense of space. Thus, the voice of the person being interviewed would be perceived as coming directly from the playback screen, while the voices of others in the scene or the sounds of cars in the scene would be perceived as coming from their respective directions. However, as described in more detail below, a more compelling cinematic experience can be obtained where the audio recording is given a spatial profile (by the spatial sound rendering process) that better matches the spatial focus of the audio-video recording. In the example of FIG. 1, this means that the voices of others in the scene and of other ambient sounds that were captured (such as cars or buses) should be spatially rendered but in such a way that enables the listener to focus on the voice of the interviewee.

Figure 2:
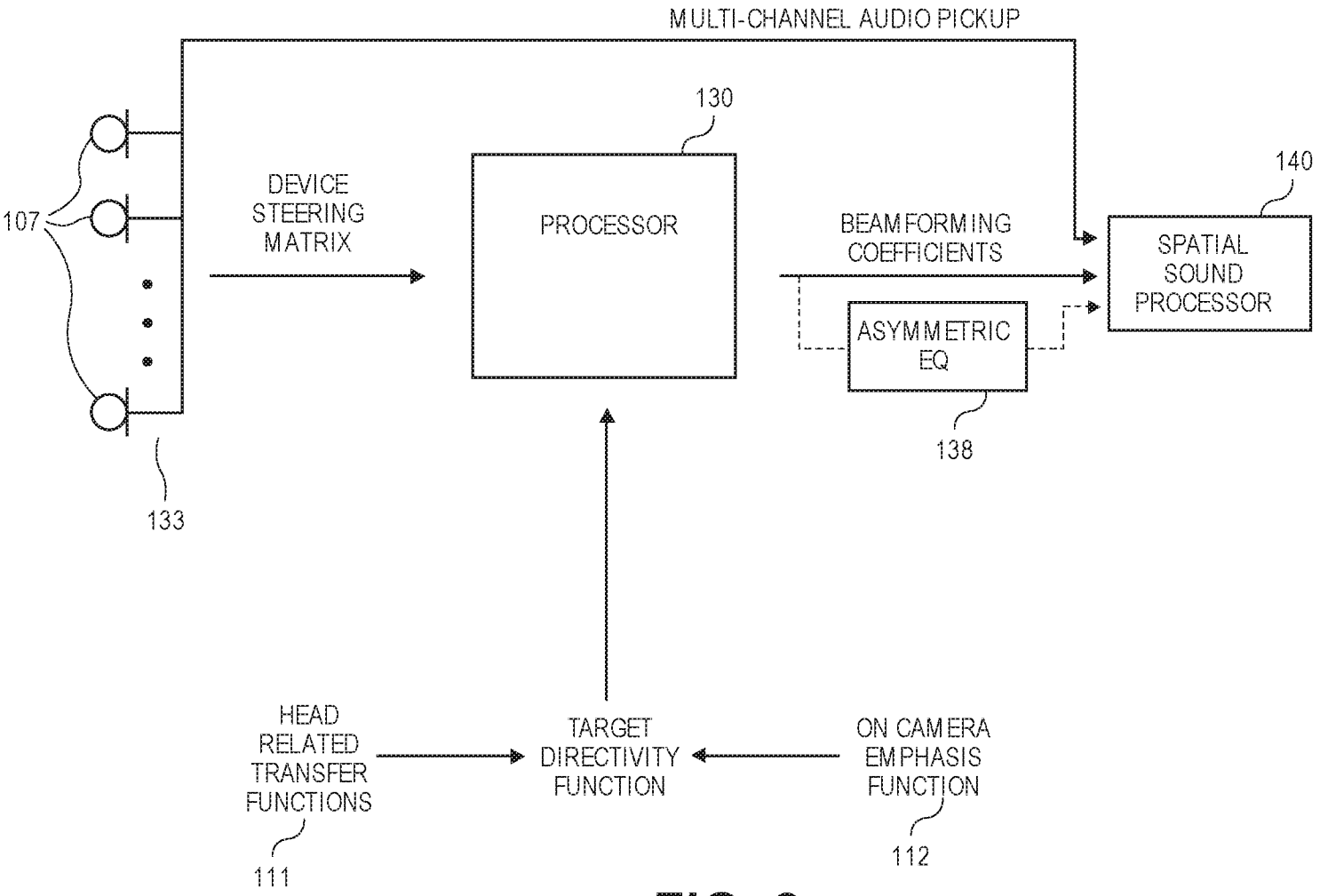
FIG. 2 is a diagram of an audio system for outputting spatially biased beamforming coefficients that are applied to multichannel audio pickup from the multimedia recording device.

FIG. 2 is a diagram of an audio system for generating or outputting spatially biased beamforming coefficients that are used by a spatial sound processor such as a binaural renderer. The spatial sound processor processes a digital, multichannel sound or audio pickup coming from an array 133 of microphones 107, as part of a contemporaneous video recording being made by the device 100 (see FIG. 1.) This process is also referred to here as binaural video rendering. The audio system has a processor 130 that is to execute instructions stored in memory to apply a target directivity function to a device steering matrix. The device steering matrix describes how the microphone array 133 responds to sounds coming from a number of (two or more, L) directions. The steering matrix may include a collection of impulse responses (transfer functions, in frequency domain, obtained either through free-field device measurements or wave simulations, between each of the microphones 107 of the microphone array 133 and the L directions or positions in space, in order to convey an accurate representation of the expected phase differences between the microphones. These known transfer functions may be measured in advance of the video recording session (including in advance of the recording device being shipped to its end user), such as in an anechoic chamber.

The target directivity function defines a desired beam width and direction, and is applied to the steering matrix to yield a set of beamforming coefficients. The latter are then applied by the spatial sound processor 140 (see FIG. 1) to the multi-channel audio pickup to produce beamformed audio signals which are then spatially rendered by a binaural rendering algorithm into a left earphone signal and a right earphone signal.

Figure 3:
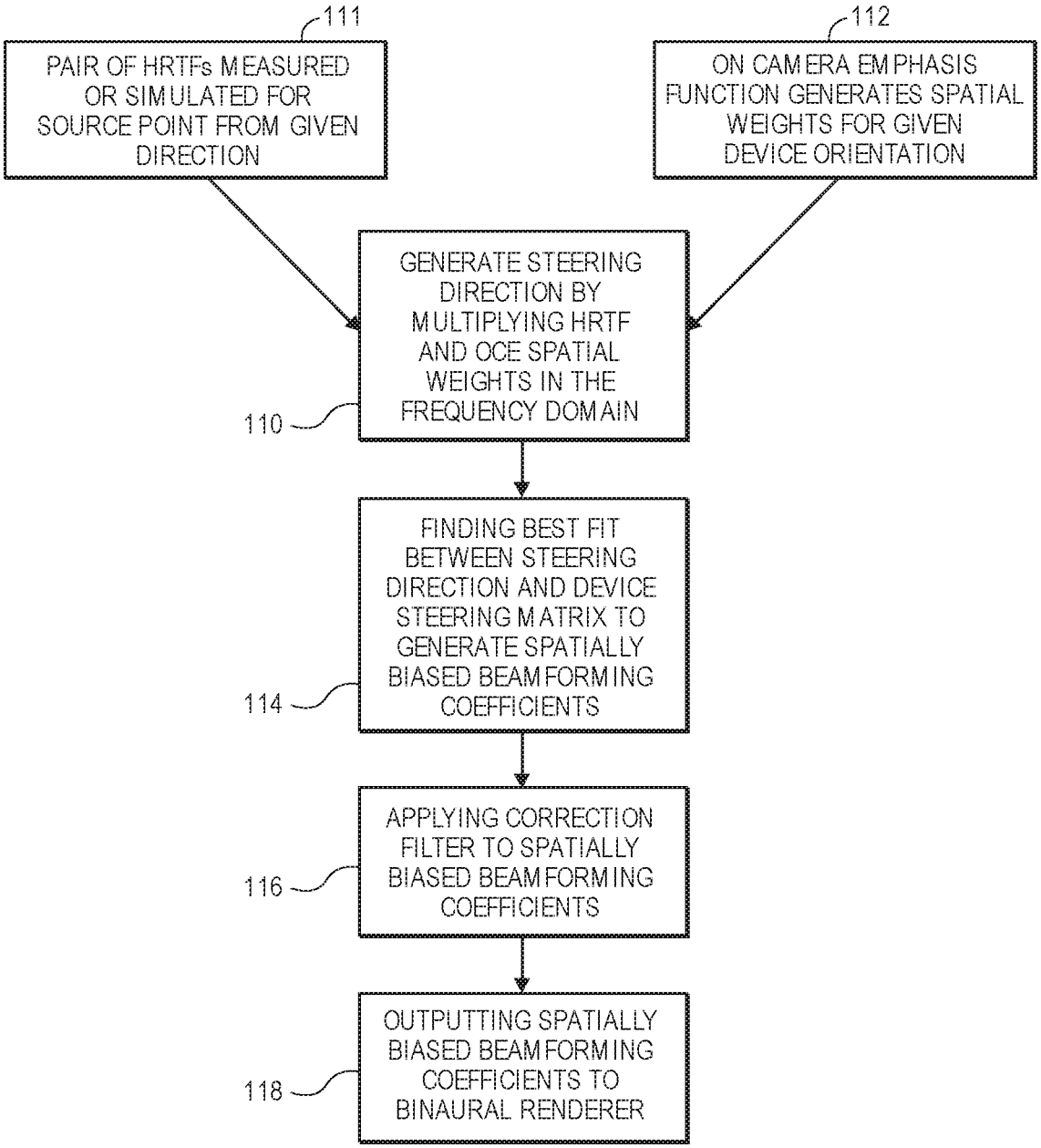
FIG. 3 illustrates a flow diagram of a process for generating spatially biased beamforming coefficients.

Referring now to the flow diagram of FIG. 3, the target directivity function is generated in block 110, by taking a selected set of head related transfer functions (HRTF) given in block 111 and applying to them a selected On-Camera Emphasis, OCE, function (given in block 112.) This yields a spatially weighted HRTF that in effect defines the desired steering direction and beam width, or target directivity function. The selected HRTF in block 111 is selected from a number of stored head related transfer functions that are associated with the L directions, respectively (a separate set of left ear and right ear transfer functions for each of L directions.) This collection of HRTF may be free-field HRTFs which are either measured at the left and right ears of a person or manikin, or they may be simulated.

Figure 4B:
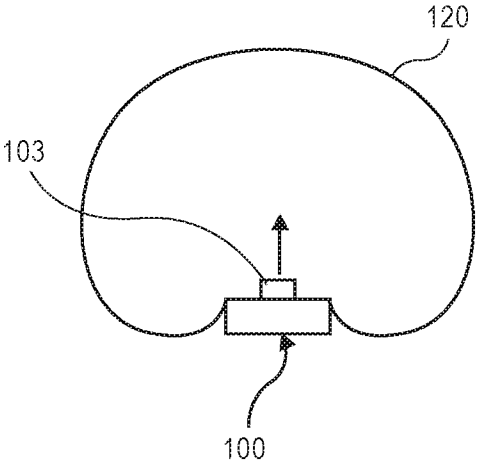
FIG. 4A and FIG. 4B illustrate example sound pickup patterns for a microphone array on a multimedia recording device.
Figure 4A:
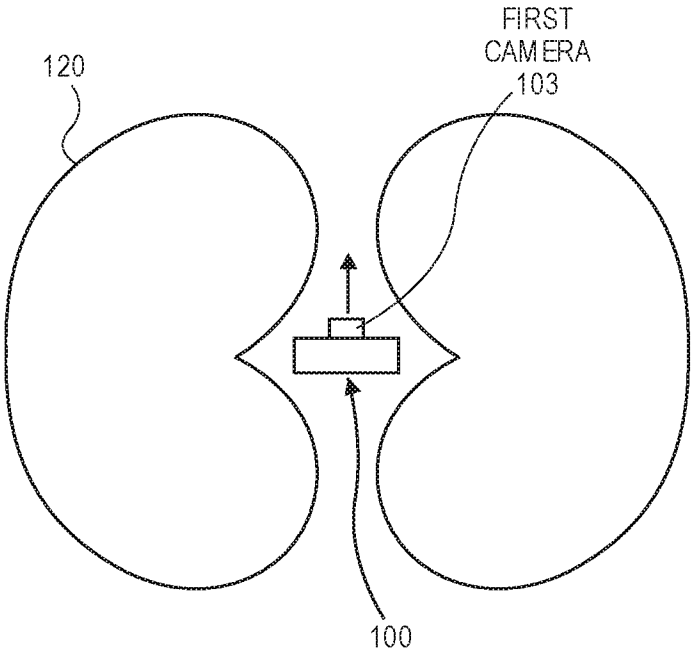

The OCE function given in block 112 is a collection of spatial weights that are designed to modify a target or selected HRTF such that the sound field of the HRTF will be given a predetermined geometry (induced sound field geometry) by emphasizing level at one or more desired directions and reducing (e.g., minimizing) level at undesired directions. For example, FIG. 4A illustrates an example of an ordinary sound field 120 for a device with a first free-field microphone and a second free-field microphone. FIG. 4B shows an aspect where the OCE may modify the HRTF such that the sound field 120 as reproduced by applying the HRTF may have an emphasis on sound that is on the imaging axis of a camera of the device 100 (that is being used or that was used to record the video), or the direction at which the camera is facing. This is also referred to as producing a directionally biased HRTF.

Returning to FIG. 3, operation continues with block 114 in which the target directivity function (that includes the generated steering direction) is applied to the device steering matrix. This results in a set of beamforming coefficients being generated. The set of beamforming coefficients includes at least one left ear beamforming coefficient and at least one right ear beamforming coefficient. In one aspect, the set of beamforming coefficients are generated by the processor 130 determining an optimal fit for the directionally biased HRTF from the target directivity function based on the device steering matrix.

Any suitable approach may be used in block 114, to find an optimal fit for the directionally biased HRTF. In one aspect, an iterative least squares method may be used to find the optimal fit, in which the target directivity function (e.g., steering direction) and the device steering matrix are inputs to a least squares beamformer design algorithm (executed by the processor 130.) The method of least-squares is an approach in regression analysis to approximate the solution of overdetermined systems, i.e., sets of equations in which there are more equations than unknowns. "Least-squares" means that the overall solution minimizes the sum of the squares of the residuals made in the results of every single equation. The best fit in the least-squares sense minimizes the sum of squares of residuals, where a residual can be described as the difference between an observed value and the fitted value provided by a model. The least-squares method may determine for each microphone an optimal fit between i) the spatial weights of the directionally biased HRTF that best corresponds with a microphone and ii) the transfer functions for the corresponding microphone represented in the device steering matrix. The least squares beamformer design algorithm outputs a set of beamforming coefficients for each microphone, such that the output includes left beamforming coefficients for all microphones represented in the array and right beamforming coefficients for all microphones represented in the array.

In one aspect, the iterative-least squares method may be subject to a determined white-noise gain constraint. White-noise gain is uncorrelated noise, such as from electric self-noise, that may be amplified during the optimal fit process. The white-noise gain constraint is a maximum noise amplification that is allowable while finding the best fit. The iterative-least squares method produces regularizer parameters, which is the "error" value that is allowed by the best fit when considering the white-noise gain constraint. The regularizer parameters derived for the first ear are then used when determining the best fit of the OCE-adjusted HRTFs based on the device steering matrix for the second ear in order to generate beamforming coefficients for the second ear.

Figure 6:
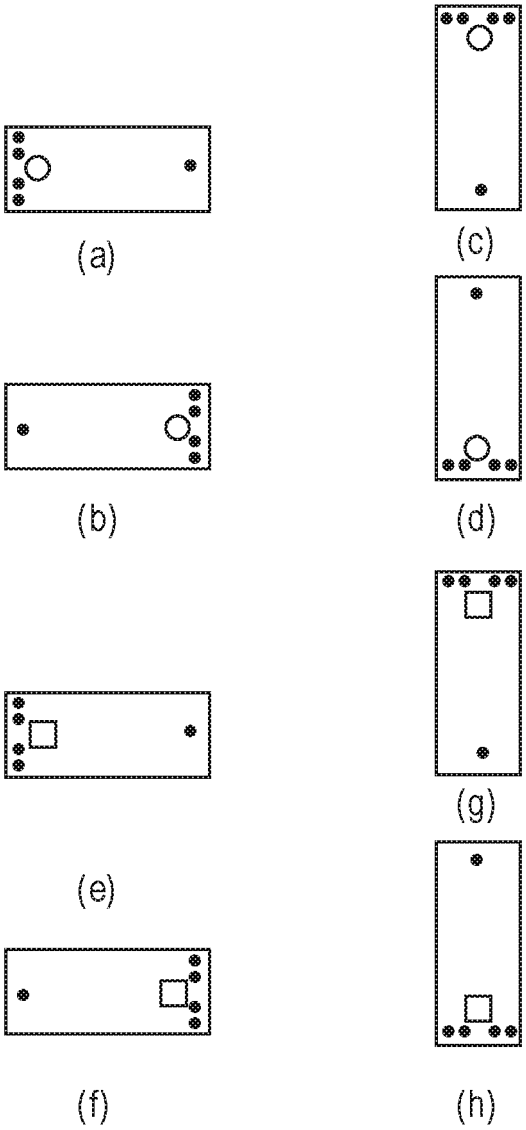
FIG. 6 illustrates example landscape and portrait orientations of the multimedia recording device of FIG. 4.

The determination of whether a left side or a right side constitutes a first ear may be made based on the microphone configuration of the device 100. In an aspect, the first ear may be the ear that is on the same side of a vertical center axis, of the device 100, as the side of the device 100 that has a lower microphone density. For instance, the first ear is the left ear of the user who is holding the device 100 during the video recording, if the left side of the device 100 has a lower density of microphones than the right side of the device as in the orientation shown in FIG. 6(*b*). In another instance, the first ear is the right ear of the user if the right side of the device 100 has a lower density of microphones than the left side of the device 100 when oriented as shown in FIG. 6(*a*) or FIG. 6(*c*).

In one aspect, the process in FIG. 3 may then proceed with block 116 in which a correction filter is applied to the left set of beamforming coefficients and the right set of beamforming coefficients (produced in block 114.) This is also referred to here as processing by an asymmetric equalizer 138. The asymmetric equalizer 138 may be implemented as the processor 130 programmed in accordance with an algorithm described as follows.

The sets of beamforming coefficients produced by the least fits method may be spectrally-biased, such that the perceived timbre of the resulting binaural signal may not match the desired timbre. Moreover, since a regularizer is chosen based on a single ear, the resulting spectrum at the left and right ears may not be consistent, particularly when the arrangement of the microphones 7 that constitute the array 133 is not left-right symmetric. Since at high frequencies the human auditory localization system relies on interaural level differences, such spectral discrepancies may result in competing auditory cues, which may cause a degradation in spatial localization. The asymmetric equalizer 138 applies a correction filter to the beamforming coefficients, such that the diffuse field power average of the resulting beamforming weights of both ears (averaging both space and ears) would equal the diffuse field power average of a reference microphone on the device 100. The same transfer function is applied to the sets of coefficients for both the left ear and the right ear, resulting in symmetric equalization. In an aspect considering asymmetric equalization, the diffuse field average is computed independently for the left ear and the right ear, resulting in a left filter for the left ear and a right filter for the right ear. The correction filter for the left ear is applied to the left ear beamforming coefficients, and the correction filter for the right ear is applied to the right ear beamforming coefficients, correcting for the interaural-level difference errors in the device 100 that has left-right asymmetrical microphone arrays.

Finally, the asymmetric equalizer 138 outputs the corrected, left set of spatially weighted beamforming coefficients, and corrected, right set of spatially weighted beamforming coefficients, to the spatial sound processor 140 (e.g., a binaural renderer.) The latter then applies those beamforming coefficients to the multichannel audio pickup produced by the array 133 of the device 100, as part of the recorded audio-video program.

Figure 5:
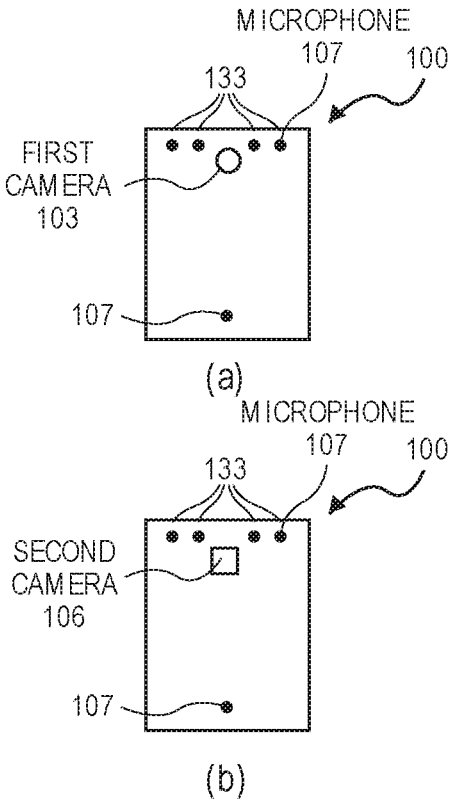
FIG. 5 illustrates front camera and rear camera orientations of an example multimedia recording device.

In an aspect, the multimedia recording device 100 is capable of recording video and audio in a variety of orientations. For instance, the multimedia recording device 100 may have two or more cameras, either of which may be used to make the video recording. FIG. 5(*a*) shows a first camera 103 located on a first side of the multimedia recording device 100 closer to a first edge than an opposing edge ("looking out from" the first side.) FIG. 5(*b*) shows a second camera 106 located on a second side of the multimedia recording device 100 (looking out from a second side that, in this case is directly opposite the first side), also positioned closer to the first edge than the opposing edge. This arrangement can be found for example in a typical smartphone or tablet computer. The multimedia recording device 100 may be able to record video using either camera, and in any one of a plurality of orientations such that the direction that is deemed "up" and the direction that is "left" points to different sides or edges of the device 100 depending on the orientation and which camera is selected by the user. For example, a user may record a video in one of the following orientations:

a. a first orientation where the first camera 103 is being used to record the video, and the multimedia recording device 100 is held in a landscape orientation with the first edge facing left, as in FIG. 6(*a*);
b. a second orientation where the multimedia recording device 100 is held in landscape orientation and is using the first camera 103 but the first edge facing right, as in FIG. 6(*b*);
c. a third orientation where the multimedia recording device 100 is held in portrait orientation and is using the first camera 103 to record the video, with the first edge facing up, as in FIG. 6(*c*);
d. a fourth orientation where the multimedia recording device 100 is held in portrait orientation, is using the first camera 103, and the first edge is facing down, as in FIG. 6(*d*);
e. a fifth orientation where the second camera 106 is being used to record the video, and the multimedia recording device 100 is held in a landscape orientation with the first edge facing left, as in FIG. 6(*e*);
f. a sixth orientation where the multimedia recording device 100 is held in landscape orientation and using the second camera 106, with the first edge facing right—FIG. 6(*f*);
g. a seventh orientation where the multimedia recording device 100 is held in portrait orientation, and is using the second camera 106 with the first edge facing up—FIG. 6(*g*); and h. an eighth orientation where the multimedia recording device 100 is held in portrait orientation with the first edge facing down and is using the second camera 106—FIG. 6(*h*).

Each orientation may have an associated, respective On-Camera Emphasis (OCE) function. Sets of left beamforming coefficients and right beamforming coefficients may be generated for each orientation, using the OCE that is associated with that orientation. Thus, a library of sets of beamforming coefficients is generated, wherein each set is associated with a possible multimedia recording device 100 orientation.

In an aspect, a set of left beamforming coefficients and right beamforming coefficients for a specific orientation may be selected, which orientation matches that of the multimedia recording device 100 while it is recording video. This set selected left beamforming coefficients and right beamforming coefficients are then output to the spatial sound processor 140. The spatial sound processor 140 may use the left beamforming coefficients to generate a binaural output signal from an audio input signal, by beamforming. The binaural output signal may be output to a speaker system, such as left and right earphones (headphones) of a headset. In an aspect, the multimedia recording device 100 may generate the set of left beamforming coefficients and right beamforming coefficients in real-time, by the processor 130 executing an algorithm, instead of selecting a set of beamforming coefficients from a library that has been created "offline" or not on the multimedia recording device.

In an aspect, the induced sound field geometry (for sound pickup—see FIG. 4A and FIG. 4B for example) may be determined by different aspects of the orientation data or orientation characteristics of the multimedia recording device 100. For instance, elements of the multimedia recording device 100 orientation data may be used to determine what induced field geometry best matches the user's intent. For example, if the camera being used to record the video is the one that is facing the user of the device 100, while the multimedia recording device is in a portrait orientation, then the user is likely recording herself. In that case, the induced sound field geometry (for processing the multichannel audio pickup by the device 100) should be more narrowly focused (narrow beam width, or high directivity.) In another example, if a user is recording using the so-called rear camera that is facing away from the user of the device 100, and in landscape mode, then a broader sound field geometry may be desired (wider beam width, or low directivity.) In another example, if a user before or during a recording changes from a long shot to a close-up (zooming in), then an OCE with a narrow induced field geometry may be selected. In that case, there may be an OCE lookup table in which several OCEs have been defined or stored for different camera zoom settings of the device 100, respectively. If the camera finds itself in a zoom setting that is in between two stored zoom settings of the OCE lookup table, then a "selected" OCE may be interpolated by interpolating from the two stored zoom settings. In one aspect, this interpolation should ensure that the phase relationship between the new, interpolated OCE and a current OCE (that is being used to generate the steering direction and render the program audio of the video recording), are "aligned" so as to avoid creating audio artifacts when the new OCE is applied to render the audio program.

Various aspects of generating sets of beamforming coefficients from spatially weighted HRTFs may be used in applications where spatially biased audio is desired, by creating an OCE that emphasizes spatial focus in a determined direction. For example, it may be desirable for a hearing aid to focus sound in a direction that a user is facing, and so an OCE could be designed for that case which shapes the sound profile by the method discussed.

In another aspect of the disclosure here, the programmed processor automatically selects a more "aggressive" OCE that is associated with a narrower pickup beam width, or higher directivity, in response to detecting that the recording device 100 is zooming in (the lens system of the camera is being adjusted past a first threshold, such that an object that is captured in the video now appears larger.)

In some cases, equalization (spectral shaping) is applied to correct for timbre changes that appear due to the newly selected OCE (e.g., when the OCE is focusing on the voice of a person.) To reduce the likelihood of such timbre changes (when switching between different OCEs), block 114 of FIG. 3 may be modified to force a constraint on the algorithm that finds the best fit. The constraint may be that on-axis response of the new beam (that is defined by the spatially biased beamforming coefficients computed in block 114) should remain unchanged (e.g., within a threshold or tolerance band) relative to the current beam. Of course, that means that the timbre of sounds coming from off-axis directions may change when zooming in, but that is acceptable so long as the voice of a person onto which the camera is zooming in (and which is considered the on-axis sound) does not exhibit a noticeable change in timbre.

When rendering spatial audio that is responsive to the camera zooming in, one of the following choices can be made when computing the new beamforming coefficients (for the zoomed in setting.) In one choice, a constraint is placed on the beamforming algorithm that leads to the on-axis sound level becoming greater (e.g., the person at the center of the video images is being zoomed in upon and their voice will become louder) while off-axis sound levels (e.g., voices of persons and objects that are not at the center of the video images) remain unchanged. In another choice, the constraint placed on the beamforming algorithm leads to the on-axis sound level remaining unchanged while off-axis sound levels are attenuated.

In yet another aspect, the programmed processor omits or does not apply any OCE (that narrows the focus of the sound pickup) in response to detecting that the user of the recording device 100 is manually zooming out (adjusting the lens system of the camera past a second threshold such that the object that is being captured in the video will appear smaller in the images.

In summary, aspects of the disclosure are directed to methods and systems for maintaining the immersion offered by binaural recordings while at the same time keeping auditory focus on the video playback. The method involves using an On Camera Emphasis (OCE) function, which modifies HRTFs to enhance directional bias. The output is a binaural signal which amplifies sounds in the direction of the camera and attenuates sounds in other directions, while maintaining spatialization.

While certain aspects have been described and shown in the accompanying drawings, it is to be understood that such aspects are merely illustrative of and not restrictive on the broad disclosure, and that the disclosure is not limited to the specific constructions and arrangements shown and described, since various other modifications may occur to those of ordinary skill in the art. For example, FIG. 5 depicts the multimedia recording device 100 as having five microphones and one camera on each side of the device, of which four microphones are near the first edge and a single microphone is near the opposing edge. In other cases, different quantities and geometries of microphones may be used, as well as different quantities and locations of cameras. The description is thus to be regarded as illustrative instead of limiting.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

What is claimed is:

1. A method for producing a spatially biased sound pickup beamforming function, the method comprising:

generating a target directivity function that includes a set of spatially biased head related transfer functions;

generating a left ear set of beamforming coefficients and a right ear set of beamforming coefficients by determining a fit for the target directivity function based on a device steering matrix; and applying the left ear set of beamforming coefficients and the right ear set of beamforming coefficients to a multi-channel audio recording of an audio-video recording made by a multimedia recording device to produce a binaural output signal, to be output to left and right earphones during playback of the audio-video recording.

2. The method of claim 1, wherein the device steering matrix includes a plurality of transfer functions of a plurality of microphones, wherein each of the transfer functions describes a response by a respective one of the microphones to a single sound source direction.

3. The method of claim 2, wherein the fit for the target directivity function is determined by utilizing a least squares method, wherein the least squares method comprises inputting the target directivity function and the device steering matrix into a least squares beamformer design algorithm.

4. The method of claim 3, wherein the least squares beamformer design algorithm includes a determined white-noise gain constraint while determining a fit for the target directivity function based on a device steering matrix for a first ear.

5. The method of claim 4, wherein the least squares method produces regularizer values due to the white-noise gain constraint while generating a set of beamforming coefficients for the first ear, and the regularizer values produced for the first ear are used in the least squares method for generating a set of beamforming coefficients for a second ear.

6. The method of claim 5, wherein the first ear is the left ear if the left side of the multimedia recording device has a lower density of microphones than the right side of the device, or the first ear is the right ear if the right side of the multimedia recording device has a lower density of microphones than the left side of the device.

7. The method of claim 1, further comprising:

selecting a set of head related transfer functions (HRTFs); and selecting an on-camera emphasis function (OCE) in response to detecting an orientation of the multimedia recording device that has a plurality of possible orientations for capturing audio-video, wherein the OCE includes a plurality of spatial weights, wherein generating the target directivity function comprises producing the set of spatially biased HRTF by multiplying in frequency domain the set of HRTFs with a first set of spatial weights from the OCE that emphasize sound from a first desired direction.

8. The method of claim 1, further comprising processing the left ear set of beamforming coefficients and the right ear set of beamforming coefficients with an asymmetric equalizer.

9. The method of claim 1, wherein the left ear set of beamforming coefficients and the right ear set of beamforming coefficients are associated with an orientation of the multimedia recording device while the device is recording audio and video, wherein multimedia recording device can record in a plurality of orientations.

10. The method of claim 9, further comprising generating a beamforming coefficients library that includes a plurality of sets of left and right ear beamforming coefficients wherein each set of left ear beamforming coefficients and right ear beamforming coefficients are associated with a respective orientation of the device.

11. A method for producing a target directivity function, the method comprising:

selecting a set of head related transfer functions (HRTFs);

selecting an on-camera emphasis function (OCE) that is specific to an orientation of a video recording device that can record audio and video in a plurality of orientations, wherein the OCE includes a plurality of spatial weights; and generating a set of spatially biased HRTFs, wherein the set of spatially biased HRTFs are generated by multiplying in frequency domain the set of HRTFs with a first set of spatial weights from the OCE that emphasize sound from a first desired direction.

12. The method of claim 11 wherein selecting the OCE is in response to detecting that the video recording device is zooming in, and wherein the selected OCE when zooming in has a narrower sound pickup beam width or higher directivity than another OCE that is selected when the video recording device is not zooming in.

13. The method of claim 11 further comprising detecting that the recording device is zooming out, in response to which a default OCE is selected.

14. The method of claim 11 further comprising detecting that the recording device is zooming out, and in response providing the selected set of HRTFs directly to a spatial sound renderer for binaural rendering without any spatial bias that would be present due to application of the OCE.

15. The method of claim 11, wherein the OCE is selected from a plurality of OCEs, wherein each OCE of the plurality of OCEs is specific to an orientation of the device and the selected OCE is associated with an orientation that matches the orientation of the recording device while the recording device is being used to record the audio and video.

16. The method of claim 11 wherein the OCE is designed to produce a desired sound profile that emphasizes spatial focus in a determined direction and reduces sound level at undesired directions, wherein the determined direction matches a direction at which a camera of the recording device is aimed to record video.

17. A system for producing a sound pickup beamforming function to be applied to a multi-channel audio recording made by a video recording device, comprising a processor; and memory having stored therein instructions that when executed by the processor generate a target directivity function that includes a set of spatially biased head related transfer functions, generate a left ear set of beamforming coefficients and a right ear set of beamforming coefficients by determining a fit for the target directivity function based on a device steering matrix that describes beamforming capability of a microphone array in the video recording device;

apply the left ear set of beamforming coefficients and the right ear set of beamforming coefficients to a multi-channel recording made by the microphone array to produce a binaural output signal.

18. The system of claim 17, wherein the device steering matrix includes transfer functions of a plurality of microphones that constitute the microphone array.

19. A method for asymmetric equalization, comprising:

a) receiving a set of beamforming coefficients for a first ear;

b) calculating a diffuse field power average across a plurality of beamforming coefficients from the received set of beamforming coefficients; and c) applying a correction filter to the received set of beamforming coefficients such that the diffuse field power average of the plurality of beamforming coefficients equals the diffuse field power average of a single microphone of a microphone array.

20. The method of claim 19 further comprising:

receiving a further set of beamforming coefficients for a second ear;

calculating a diffuse field power average across a further plurality of beamforming coefficients from the received further set of beamforming coefficients; and applying a correction filter to the received further set of beamforming coefficients such that the diffuse field power average of the further plurality of beamforming coefficients equals the diffuse field power average of a single microphone of the microphone array.

* * * * *